United States Patent [19]

Ulrich et al.

[11] Patent Number: 4,632,666

[45] **Date of Patent: * Dec. 30, 1986**

[54] CARTON ERRECTOR APPARATUS

[75] Inventors: Lawrence W. Ulrich, Cicero; Connie W. Walker, Bolingbrook, both of Ill.

[73] Assignee: Durable Packaging, Chicago, Ill.

[ * ] Notice: The portion of the term of this patent subsequent to Apr. 1, 2003 has been disclaimed.

[21] Appl. No.: 791,445

[22] Filed: Oct. 25, 1985

Related U.S. Application Data

[63] Continuation-in-part of Ser. No. 590,073, Mar. 15, 1985, Pat. No. 4,579,551.

[51] Int. Cl.[4] ..... B31B 1/80; B31B 5/74

[52] U.S. Cl. ..... 493/23; 493/183; 493/316

[58] Field of Search ..... 493/309, 313, 316, 317, 493/123, 124, 125, 126, 127, 177, 178, 183, 23

[56] References Cited

U.S. PATENT DOCUMENTS

| | | | |
|---|---|---|---|
| Re. 27,631 | 5/1973 | Berney | 493/313 |
| 2,289,820 | 7/1942 | Ardell | 493/316 |
| 3,156,167 | 11/1964 | Galloway | 493/317 |
| 4,285,679 | 8/1981 | Wahle | 493/125 |
| 4,285,682 | 8/1981 | Moss | 493/316 |
| 4,439,174 | 3/1984 | Derderian | 493/125 |

*Primary Examiner*—Lowell A. Larson
*Assistant Examiner*—William E. Terrell
*Attorney, Agent, or Firm*—Dressler, Goldsmith, Sutker, Shore & Milnamow

[57] ABSTRACT

A carton erector apparatus for setting up folding carton blanks and folding their bottom flaps. The apparatus includes a carton blank storage section, a carton blank set-up section and a bottom flap folding section. The carton blank storage section includes a magazine assembly for storing and urging knocked-down carton blanks towards the carton set-up section. The carton set-up section includes a carton opening assembly comprising a pivot arm assembly pivotally secured to the folding arm assembly. The pivot arm assembly is movable between first and second positions respectively parallel and perpendicular to the folding arm assembly. A grasping arrangement is secured to the pivot arm assembly to grasp the side panel of the forward carton in the magazine assembly such that movement of the pivot arm assembly and the folding arm assembly into their second positions is effective to set-up the carton blank into a tubular form. Bottom flap folding assemblies are provided to infold the bottom flaps of the set-up carton.

24 Claims, 5 Drawing Figures

CARTON ERRECTOR APPARATUS

This application is a continuation-in-part of U.S. patent application Ser. No. 590,073, filed on Mar. 15, 1985, now U.S. Pat. No. 4,579,551.

BACKGROUND OF THE INVENTION

This invention relates to carton erecting apparatus for setting up foldable carton blanks having side and end panels and top and bottom flaps integral therewith, and more particularly to apparatus for setting up carton blanks which are supplied to the apparatus in knocked-down form, and subsequently folding their bottom flaps.

Conventional foldable shipping containers of the rectangular four-flap type are typically manufactured from a single piece of cardboard, corrugated board, or the like, cut into a predetermined pattern and provided with indented fold lines to facilitate folding into a rectangular carton. The manufacturer usually folds the cardboard pattern once to bring two opposite edges together and then joins these two edges, such as with a strip of adhesive tape for example, to thereby form what is commonly known as a "manufacturer's joint". When the carton is set-up for use, the manufacturer's joint is at a corner defined by the meeting of an end panel and a side panel of the carton.

The carton manufacturer ships the carton blank in this compact form, each carton blank being a sheet of corrugated board folded in half and having the free ends joined by a manufacturer's joint. This compact folded configuration is designated in the art, and in the following specification and claims, by the term "knocked-down." Upon receipt by the user, each carton must be set-up by opening it to a rectangular shape and then folding the bottom flaps inwardly to a closed position. The bottom flaps are then typically maintained in the closed position by gluing, by a strip of gummed tape, or by stapling. The present invention is directed toward apparatus for setting up four-flap foldable cartons of the type known as RSC (regular slotted cartons), half telescope and the like.

The previously known apparatus which is designed for setting up and closing the bottom of such carton blanks, which are supplied as a knocked-down or collapsed tubularly formed carton or carton blank having side panels and bottom flaps and top flaps which are integral with the said sides, comprises a support which carries a magazine for the carton blanks, a feeding unit for pulling out and feeding a carton blank and a bottom closing means for folding in and possibly sealing the bottom flaps before the carton is filled. The feeding unit comprises a pneumatically acting catcher which is mounted perpendicularly to the feeding path and it is provided extendable so as to be able to catch a carton blank, pull same out of the magazine and together with the carton blank move along a feeding path while the carton is set-up to tubular form and the bottom flaps are infolded. At this stage the catcher is disengaged from the carton and moves back to catch another carton. In the previously known apparatus there is a first linear motion towards and away from the magazine to grasp and set-up the carton and a second linear motion perpendicular to the first linear motion to deliver the set up carton from the apparatus. These two linear motions necessitate a substantial increase in the exterior dimensions of the apparatus. Examples of such apparatus are disclosed in U.S. Pat. No. Re. 27,631 and U.S. Pat. No. 4,285,679.

The present invention is an alternative embodiment and improves upon the carton erecting apparatus disclosed in copending U.S. patent application Ser. No. 590,073, which application has the same inventive entity and assignee as the present invention. The carton erecting apparatus disclosed in this application includes a carton blank storage section, a carton set-up section and a bottom flap folding section. The carton blank storage section includes a magazine assembled for storing and urging knocked-down carton blanks in a substantially vertical orientation towards the carton set-up section.

The carton set-up section includes a carton opening assembly mounted on a substantially horizontal carriage plate movable in a direction transverse to the direction of movement of the cartons blanks in the magazine assembly. The carton opening assembly has a folding arm assembly and a pivot arm assembly. The folding arm assembly is pivotal about a substantially vertical shaft secured to the carriage plate and is movable between a first position generally parallel to the side panel of the forward carton blank in the magazine assembly and a second position generally perpendicular to the side panel of the carton. The pivot arm assembly is pivotably secured to the folding arm assembly and is movable between a first position substantially parallel to the folding arm assembly and a second position substantially perpendicular to the folding arm assembly.

A grasping means including at least one suction cup is secured to the pivot arm assembly for grasping the side panel of the forward carton blank from the magazine arrangement when the pivot arm assembly and the folding arm assembly are in their first positions. Subsequent movement of the pivot arm assembly and the folding arm assembly into their second positions is effective to set-up the carton blank into a tubular form with an end panel thereof in contact with the folding arm assembly. The carriage plate is movable through a substantially horizontal plane between a first position within the carton set-up section and a second position extending into the bottom flap folding section for delivery of the set-up carton thereinto.

The bottom flap folding means includes a flap kicker assembly pivotally mounted within the carton set-up section for infolding the trailing bottom end flap of the set-up carton. A longitudinally extending plough member and a pair of converging side plough bars are mounted in the bottom flap folding section for respectively infolding the leading bottom end flap and the bottom side flaps of the set-up carton as the carton travels through the bottom flap folding section.

SUMMARY OF THE INVENTION

The carton erecting apparatus of the present invention includes a carton blank storage section, a carton set-up section and a bottom flap folding section. The carton set-up section includes a carton opening assembly mounted therein. The carton opening assembly includes a folding arm assembly and a pivot arm assembly of similar construction and operation similar to that disclosed in copending U.S. patent application Ser. No. 590,073. However, in the present invention the carton opening assembly is mounted stationary in the carton set-up section.

In accordance with the present invention, a carriage assembly is mounted in the bottom flap folding section for movement in a direction transverse to the direction of movement of the carton blanks in the carton blank storage assembly. The carriage assembly is movable between a first position within the bottom flap folding section and a second position extending into the carton set-up section. A longitudinally extending plough member is mounted on the carriage assembly and movable therewith for infolding the leading bottom end flap of a set-up carton in the carton set-up section as the carriage assembly moves into its second position.

A pair of spaced apart carton receiving assemblies are mounted to the carriage assembly and movable therewith, one on either side of the plough member. These assemblies include a plurality of longitudinally spaced roller members for grasping the side panels of a set-up carton in the carton set-up section as the carriage assembly moves into its second position and the delivery of same to the bottom flap folding section as the carriage assembly returns to its first position. A pair of converging side plough bars are mounted within the bottom flap folding section for infolding the bottom side flaps as the carriage assembly returns to its first position.

DESCRIPTION OF A PREFERRED EMBODIMENT

Figure 1A:
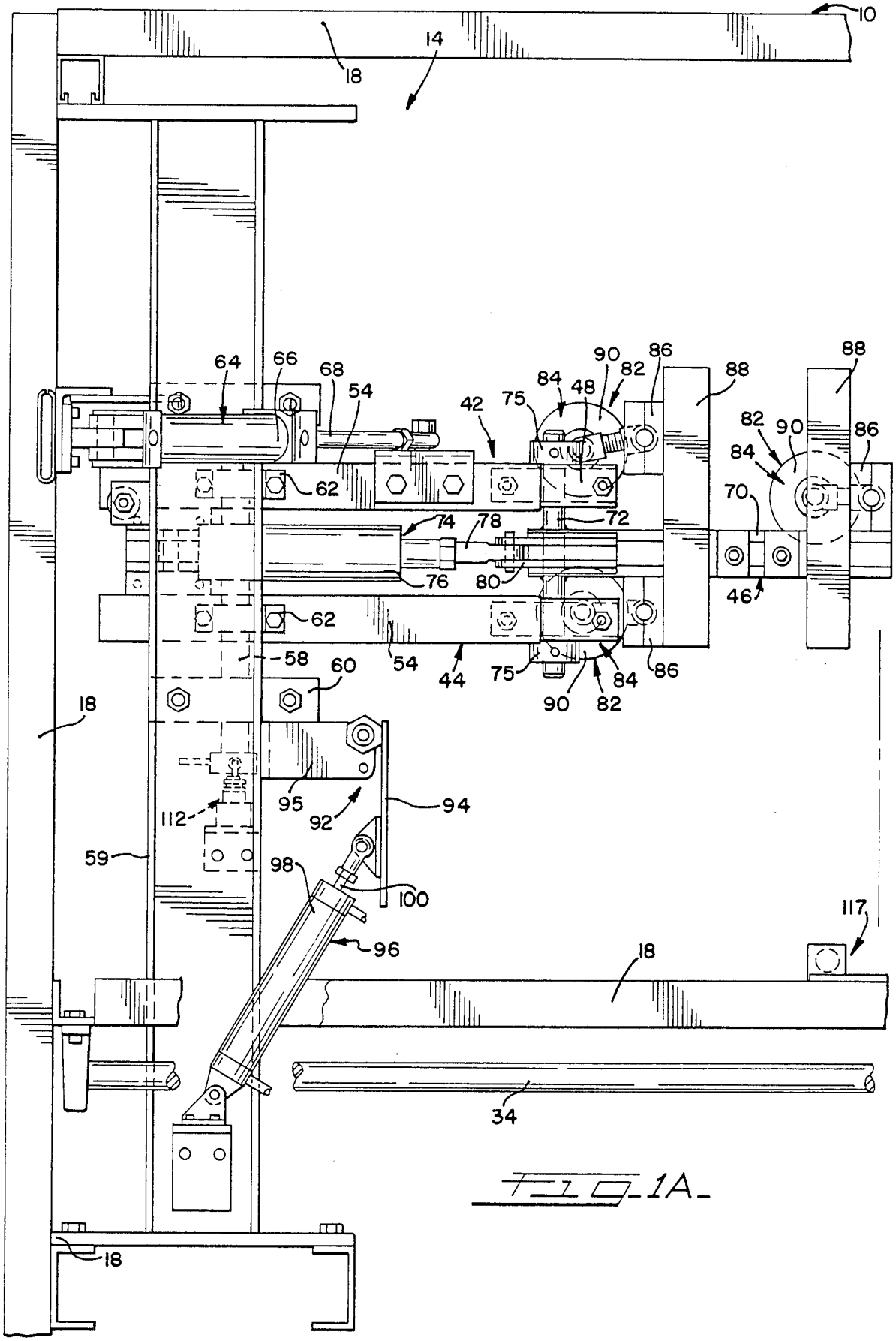
FIGS. 1A and 1B are elevational views respectively of the left end portion and the right end portion of a carton erector constructed in accordance with a preferred embodiment of the invention, with the folding arm assembly and the pivot arm assembly shown in their first positions in FIG. 1A and the carriage assembly shown in its first position in FIG. 1B.

The drawings show various views of a preferred embodiment of a carton erector apparatus indicated generally at 10. In order to facilitate the description of the apparatus 10, the apparatus may be functionally divided into a carton blank storage or magazine section 12, a carton set-up section 14 and a bottom flap folding section 16. The sections 12, 14 and 16 are mounted on a suitable frame structure indicated generally at 18. Referring to FIGS. 1A, 1B, 2A, 2B and 3, the carton blank storage section 12 extends out from one side of the frame structure 18 whereas the carton set-up section 14 and the bottom flap folding section are within the frame structure 18.

The carton blank storage section 12 includes a suitable magazine assembly 20 for supporting and individually feeding the carton blanks 22 into the carton set-up section 14. Magazine assembly 20 in a conventional manner includes inclined bottom guides 24 and side guides 26 for supporting the carton blanks 22 in a substantially vertical position. A suitable counter weight (not shown) is typically provided to urge the carton blanks towards the carton set-up section 14.

Referring to FIGS. 1A, 1B, 2A, 2B and 3, the carton set-up section 14 is located in facing relationship to the magazine assembly 20 for receipt of knocked-down carton blanks 22 thereinto.

A carton blank opening assembly 42 is mounted to frame structure 18 within section 14 for receiving a knocked-down carton blank from the magazine assembly 20 and opening the carton blank into an open tubular form for subsequent delivery to the bottom flap folding section 16. Assembly 42 includes a folding arm assembly 44 and a pivot arm assembly 46.

Figure 2A:
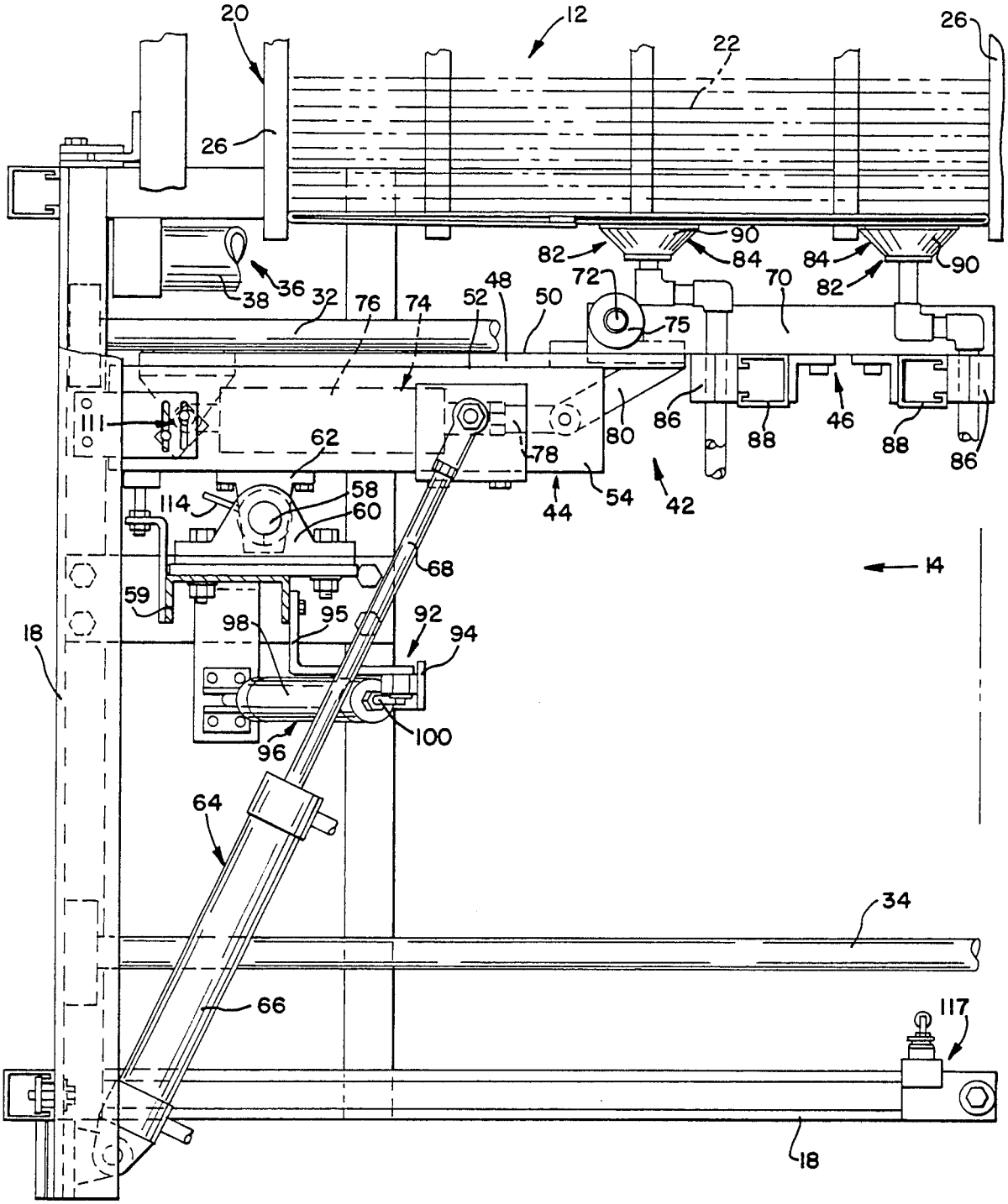
FIGS. 2A and 2B are top plan views respectively of the left end portion and the right end portion of the carton erector respectively as shown in FIGS. 1A and 1B.
Figure 3:
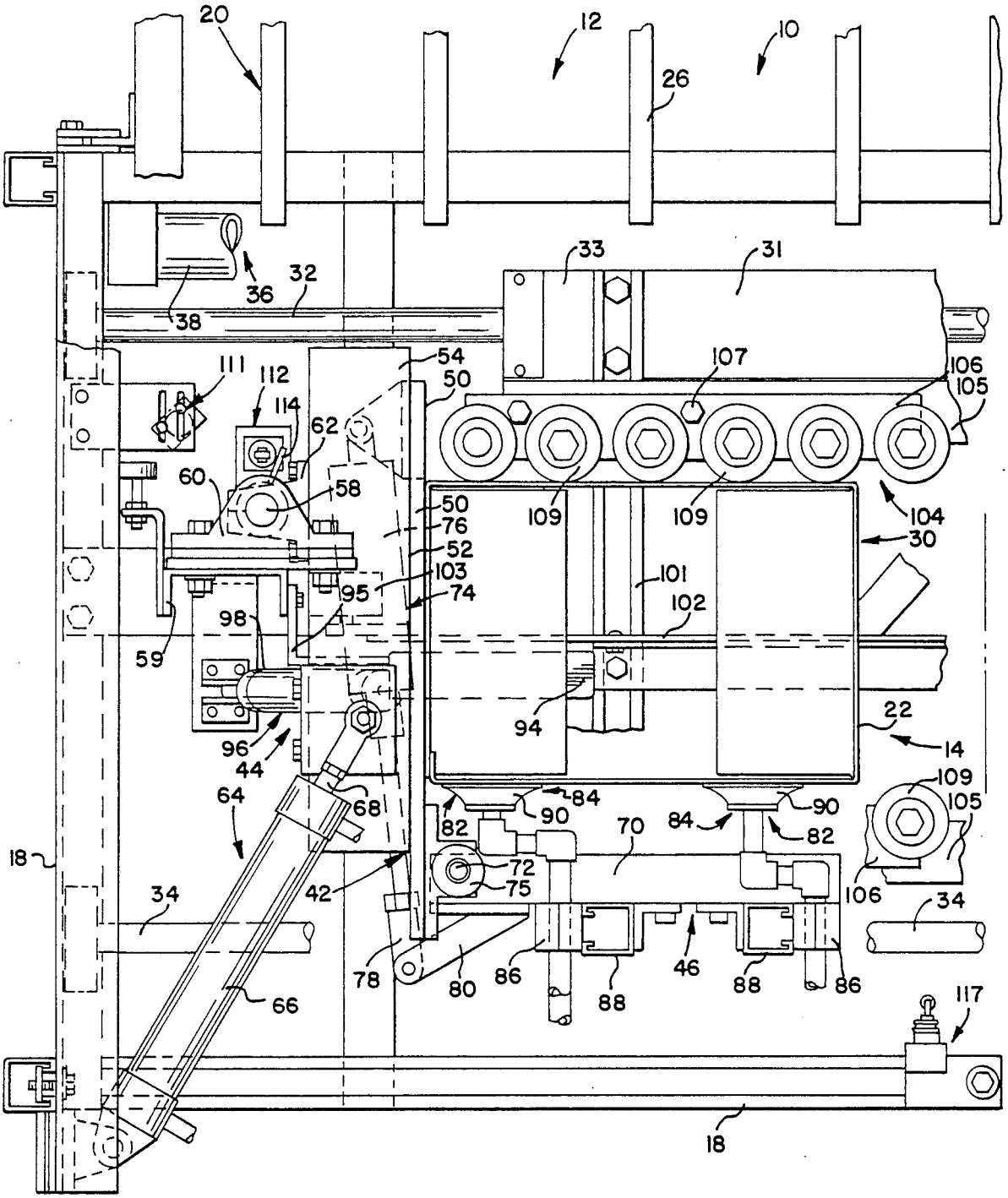
FIG. 3 is a partial top plan view of the carton erector as shown in FIGS. 2A and 2B, with the folding arm assembly and the pivot arm assembly shown in their second positions and the carriage assembly shown in its second position.

Folding arm assembly 44 includes a folding arm or plate 48 having a vertically extending front surface 50 and a rear surface 52, which is slidably secured to a pair of vertically spaced apart channel-shaped support members 54 by securing means (not shown) extending therethrough and into members 54. Support members 54 are suitably secured to a vertically extending shaft 58, which in turn is suitably rotatably secured to a vertically extending rigid frame member 59, for rotational movement therewith. Shaft 58 is rotatably mounted to the frame member 59 through a pair of vertically spaced bearing members 60. Shaft 58 extends through upper and lower clamp members 62 respectively secured to the support members 54. The pivotal movement of the folding arm assembly 44 about the vertical axis through shaft 58 is preferably controlled by a pneumatic folding arm cylinder and piston assembly 64, wherein the cylinder portion 66 is secured to the frame structure 18 and the piston portion 68 is suitably secured to upper support member 54. The extension and retraction of piston portion 68 is effective to respectively pivot folding arm assembly 44 between a first position wherein the front surface 50 is generally parallel to a side panel of the forward knocked-down carton blank in the magazine assembly 20, as seen in FIGS. 1A and 2A, and a second position wherein the front surface 50 is generally perpendicular to such side panel, as seen in FIG. 3.

Pivot arm assembly 46 includes a generally horizontally extending channel shaped pivot arm member 70 which is pivotally secured at the inner end thereof to folding arm 48 of folding arm assembly 44. The inner end of pivot arm 70 is secured to a vertical shaft 72 which in turn is rotatably received in upper and lower bearings 75 secured to surface 50 of folding arm 48. The pivotal movement of the pivot arm 70 about a vertical axis through shaft 72, relative to the folding arm assembly 44, is preferably controlled by a pneumatic pivot arm cylinder and piston assembly 74, wherein the cylinder portion 76 is suitably pivotally secured to the folding arm 48 and the piston portion 78 is pivotally secured to the inner end of pivot arm 70 through a pair of crank plates 80 secured to pivot arm 70. The retraction and the extension of the piston portion 78 is effective to respectively pivot arm 70 between a first position substantially parallel to folding arm 48, as seen in FIGS. 1A and 2A, and a second portion substantially perpendicular to folding arm 48, as seen in FIG. 3.

A plurality of suction cup assemblies 82 are mounted to pivot arm 70 for movement therewith. Assembly 82 includes a suction cup member 84 which is in communication with a source of vacuum (not shown). Suction cup member 84 is secured to a bracket 86, which in turn is secured to a substantially vertical channel member 88 secured to pivot arm 70. Suction cup member 84 is preferably vertically adjustable through the selective positioning of bracket 86 within channel member 88. Suction cup member 84 is preferably horizontally adjustable through the selective positioning of channel member 88 relative to pivot arm 70. The suction cup portions 90 of suction cup members 84 extend forward of channel member 70 toward the forward carton blank in the magazine assembly 20 when the pivot arm 70 is in its first position such that upon the application of vacuum thereto the suction cup portions 90 grasp the side panel of the carton blank.

A bottom flap kicker assembly 92 is pivotally mounted within the carton set-up section 14. Kicker assembly 92 includes a kicker plate 94 that is pivotally mounted to a bracket 95, which in turn is secured to frame member 59. Kicker plate 94 is preferably controlled by a pneumatic kicker cylinder and piston assembly 96, wherein the cylinder portion 98 is pivotally secured to frame member 59 and the piston portion 100 is pivotally secured to the kicker plate 94. It is readily apparent that the extension and retraction of the piston portion 100 is effective to respectively move the kicker plate 94 between a substantially vertical first position, as shown in FIGS. 1A and 2A and a substantially horizontal second position to infold the trailing bottom end flap of a carton, as seen in FIG. 3.

Bottom flap folding means are provided to infold the bottom side flaps and the leading bottom end flap of a set-up carton and a carriage assembly 30 is provided for receipt and delivery of a set-up carton from the set-up section 14 into the bottom flap folding section 16.

Carriage assembly 30 is mounted within a lower portion of the frame structure 18 for movement in a direction transverse to the direction of movement of the carton blanks in the magazine assembly 20. Carriage assembly 30 comprises a pair of transversely spaced carriage plates 31 suitably mounted on bearing blocks 33 for sliding movement along guide shafts 32 and 34 rigidly secured in place to frame structure 18. The movement of carriage assembly 30 is preferably controlled by a pneumatic carriage cylinder and piston assembly 36, wherein the piston portion 40 is suitably secured to the underside of one of the carriage assemblies 30 and the cylinder portions 38 are secured to the frame structure 18. The retraction and extension of the piston portion 40 is effective to respectively move the carriage plate 30 between a first position within the bottom flap folding section 16, as best seen in FIGS. 1B and 2B and a second position extending into the carton set-up section 14, as best seen in FIG. 3.

A pair of longitudinally spaced transverse channel members 101 are rigidly secured to the plate members 31 and movable therewith. A longitudinally extending plough member 102 is mounted to channel members 101 substantially along the longitudinal center line of sections 14 and 16, preferably in a manner which permits the selective vertical adjustment thereof relative to carriage assembly 30. A roller assembly 103 is preferably secured at the leading edge of plough member 102 for contacting and infolding the leading bottom end flap of the set-up carton in section 14 as the carriage assembly moves into its second position.

A pair of transversely spaced apart carton receiving assemblies 104 are secured to and extend upwardly from carriage assembly 30, one on either side of plough member 102. Assemblies 104 comprise lower and upper spaced apart longitudinally extending plates 105 and 106, which plates are secured together by spacing rods 107. Lower plates 105 are secured to channel members 101 in a suitable manner so as to permit selective transverse positioning thereof towards and away from plough member 102, as by clamp and guide assemblies 108 which are received in and ride along the channel members 101. A plurality of longitudinally spaced roller members 109 are journalled for rotation about the upper plate 106 so as to extend inwardly of the inner edge thereof. For reasons which will hereinbelow become more apparent, the leading roller 109 is preferably a brake roller for grasping the side panels of a set-up carton.

Figure 1B:
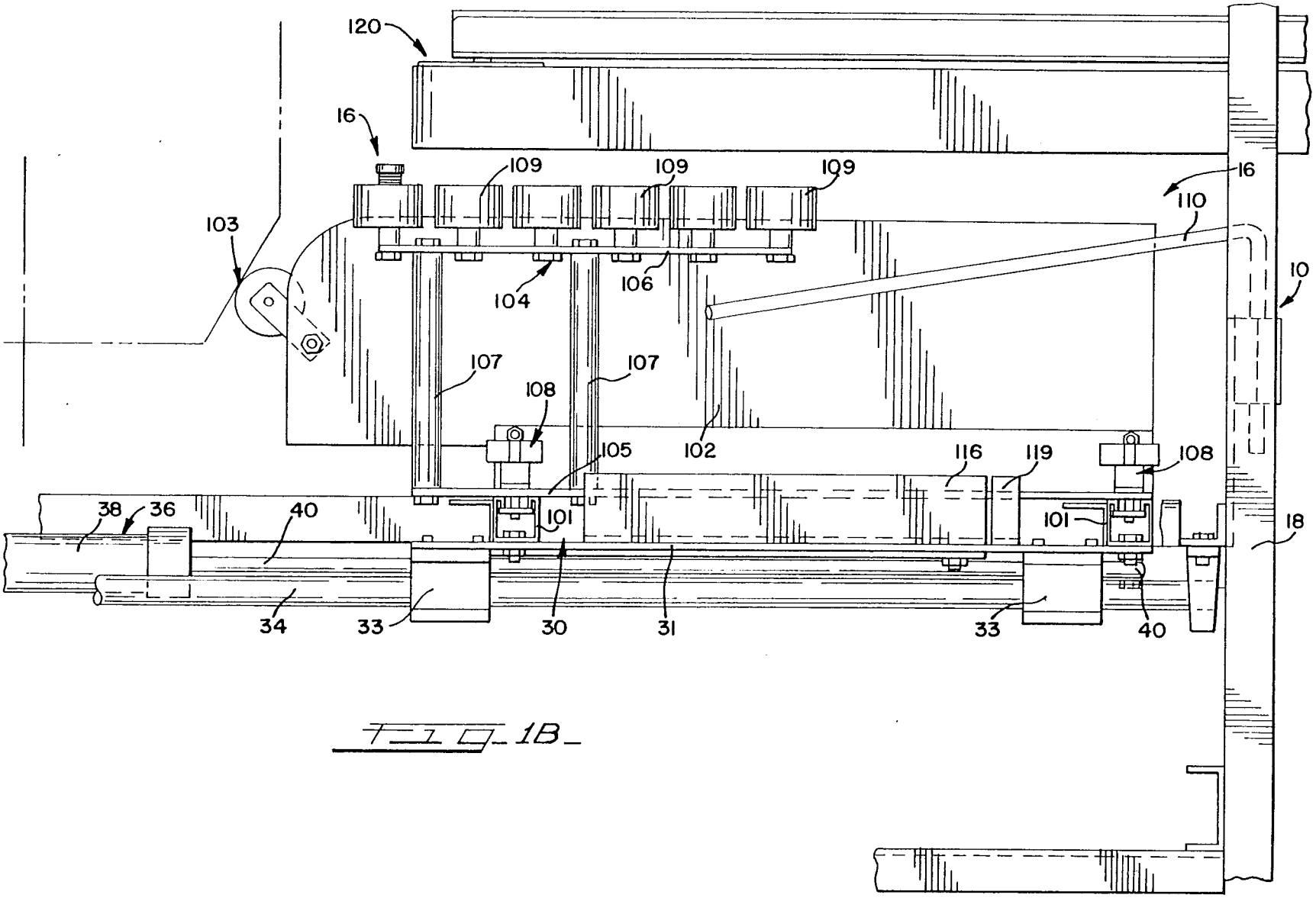
Figure 2B:
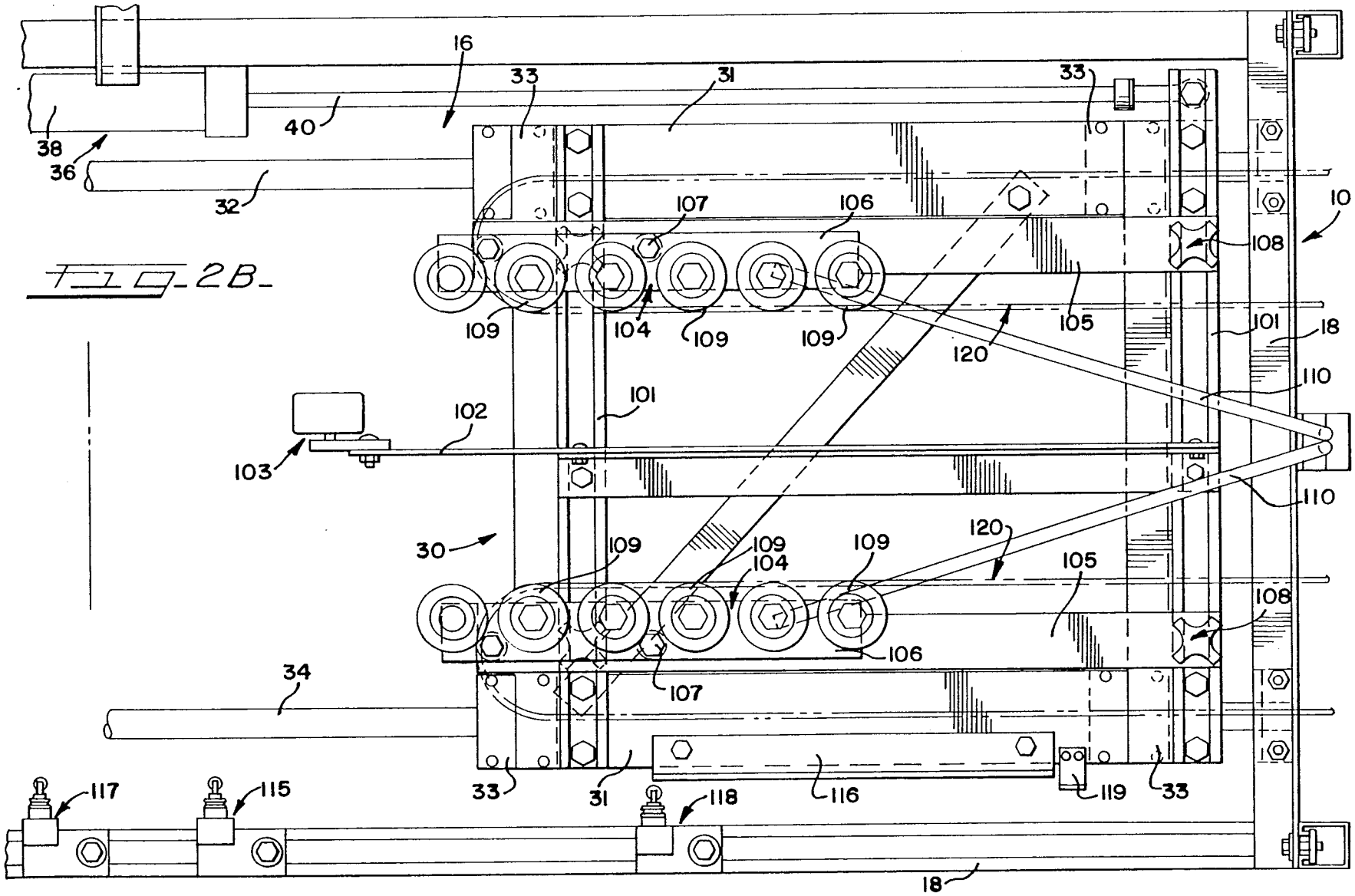

A pair of converging side plough bars 110 are mounted to frame structure 18 within section 16 for infolding the bottom side flaps in a conventional manner, as best seen in FIGS. 1B and 2B.

The sequential operation of the pneumatic cylinder assemblies 36, 64, 74, 96 are controlled by limit switches positioned on the frame structure to control power valves (not shown) in a conventional pneumatic circuit (not shown) in a manner which will hereinbelow become more apparent in the discussion of the operation of carton erector apparatus 10. A first limit switch 111 is suitably secured to the frame assembly 18 to control the retraction of the piston portion 68 of assembly 64 and thereby moves the folding arm assembly 44 from its first position (FIG. 2A) towards its second position (FIG. 3). Limit switch 111 also controls the extension of the piston portion 78 of assembly 74 and thereby moves the pivot arm assembly 46 from its first position (FIG. 2A) towards its second position (FIG. 3). Limit switch 111 also opens the source of vacuum to the suction cup members 84. Limit switch 111 is activated on contact with the upper edge of member 54 as folding arm assembly 44 moves into its first position (FIG. 1A).

A second limit switch 112 is suitably secured to frame member 59 to control the extension of the piston portion 100 of assembly 96 and thereby moves the kicker plate 94 from its first position towards its second position. Limit switch 112 also controls the retraction of piston portion 40 of assembly 36 and thereby moves the carriage assembly 30 from its first position (FIG. 2B) towards its second position (FIG. 3). Limit switch 112 is activated by a pin member 114 rotatable with shaft 58, as the folding arm assembly 44 moves into its second position, as best seen in FIG. 3.

A third limit switch 115 is suitably secured to frame structure 18 for closing the source of vacuum to the suction cup members 84. Limit switch 115 also controls the retraction of piston portion 78 of assembly 74 and thereby moves the pivot arm assembly 46 from its second position (FIG. 3) towards its first position (FIG. 2A). Limit switch 115, after a short time delay, also controls the extension of piston portion 68 of assembly 64 and thereby moves the folding arm assembly 44 from its second position (FIG. 3) towards its first position (FIG. 2A). Limit switch 115 is activated upon contact with an angle member or detent 116 secured to carriage plate 31, as best seen in FIGS. 1B and 2B.

A fourth limit switch 117 is suitably secured to frame structure 18 to control the extension of piston portion 40 of assembly 36 and thereby moves the carriage assembly 30 from its second position (FIG. 3) towards its first position (FIG. 2B). Limit switch 117 also controls the retraction of the piston portion 100 of assembly 96 and thereby moves the kicker plate 94 from its second position towards its first position. Limit switch 117 is activated upon contact with member 116, secured to carriage plate 31, as best seen in FIGS. 1B and 2B.

A fifth limit switch 118 is suitably secured to frame structure 18 such that its inward extension is less than the inward extension of switches 115 and 117. Limit switch 118 is provided to activate a speed control system (not shown) which may be provided in cooperation with assembly 36 to cushion the stopping of carriage assembly 30 as it returns to its first position. Limit switch 118 is activated by an angle member or detent 119 secured to carriage plate 31, as best seen in FIGS. 1B and 2B.

The carton erector 10 of the present invention is typically utilized in cooperation with a carton sealing apparatus for receiving the set-up carton and sealing the bottom flaps. Such carton sealing apparatus typically include conveying means for receiving the set-up carton from the bottom flap folding section 16. Referring to FIGS. 1B and 2B, a pair of spaced apart powered conveyor assemblies 120 are shown extending into section 16 for contacting the side panels of a set-up carton and directing same therethrough so as to cause the bottom side flaps to contact plough bars 110 and to deliver the carton to a suitable bottom flap sealing apparatus (not shown).

The operating cycle of erector apparatus 10 will now be described by tracing the passage of a carton 22 through the apparatus.

To prepare the apparatus for operation the magazine assembly 20 is loaded with a plurality of knocked-down carton blanks which are inserted in the magazine so that they are all vertically oriented and aligned in the same direction. The carton blanks are aligned in such a direction that their side panels have an end fold at the left, as shown in FIG. 2A. In setting up the apparatus the magazine assembly 20 is set up to accommodate the overall width of the knocked-down carton blanks in a well known manner. The magazine assembly 20 is suitably adjusted to present the carton blanks to the carton set-up section 14 so that the bottom fold lines of the cartons (which will be at the carton bottom when the bottom flaps are subsequently infolded) will be at the same height as the kicker plate 94 when it is in its horizontal position. The assemblies 104 are suitably adjusted for receipt of the specific carton size loaded in the magazine assembly 20. The folding arm 48 is adjusted relative to the support members 54 to align the longitudinal center line of the set-up carton with the plough member 102.

At the start of the operating cycle, the apparatus 10 is positioned as shown in FIGS. 1A, 1B, 2A and 2B. That is, the carriage assembly 30, the folding arm assembly 44 and the pivot arm assembly 46 are in their first positions, and the kicker plate 94 is in its vertical or first position. Also, the member 54 is in activating contact with switch 111.

With apparatus 10 so positioned, upon turning the apparatus to the "on" position, a source of vacuum is supplied to the suction cup members 84 which causes the suction cups 90 to grasp the side panel of the forward carton blank in the magazine assembly 20. Simultaneously therewith, the folding arm assembly 44 and the pivot arm assembly 46 are moved into their second positions by the respective cylinder assemblies 64 and 74, in the manner as hereinabove discussed, as is shown in solid lines in FIG. 3. As the folding arm assembly 44 and pivot arm assembly move into their second positions the leading carton blank is pulled from the magazine assembly 20 inwardly into the carton set-up section 14 by the inward movement of suction cups 90 in grasping contact with the side panel of the carton. The pivotal movement of the folding arm 48 causes surface 50 to contact the trailing end flap of the carton and open the carton blank into a tubular set-up form as the folding arm assembly 44 and the pivot arm assembly simultaneously reach their second positions.

As the folding arm assembly 44 reaches its second position, pin member 114 contacts and activates switch 112, which simultaneously causes cylinder assembly 96 to move the kicker plate 94 to its horizontal second position infolding the trailing bottom end flap and the cylinder assembly 36 to start movement of the carriage assembly 30 into its second position towards carton set-up section 14 so as to infold the leading end flap as it contacts plough member 102 and to receive and grasp the set-up carton between the rollers 109 of assemblies 104. Activation of switch 112 also deactivates the speed control system associated with cylinder assembly 36.

As the carriage assembly 30 approaches its second position, detent 116 contacts and activates switch 115 controlling the initiation of a series of operations. The source of vacuum to the suction cup members 84 is shut off releasing the set-up carton to the rollers 109. The cylinder assembly 74 initiates the movement of the pivot arm assembly 46 to return to its first position and, after a short time delay, controls cylinder assembly 64 so as to move the folding arm assembly 44 from its second position to its first position.

As the carriage assembly 30 reaches its second position, detent 116 contacts and activates switch 117 controlling the initiation of a series of operations. The cylinder assembly 36 initiates the movement of carriage assembly 30 from its second position to return to its first position delivering a set-up carton into bottom flap folding section 16. The set-up carton is received by the conveyor assemblies 120 for delivery of the carton through section 16. As the set-up carton travels through section 16, the side plough members 110 contact and infold the side bottom flaps of the set-up carton. Activation of switch 117 also controls cylinder assembly 96 so as to return kicker plate 94 from its second position to its first position.

As the carriage assembly returns to its first position, detent 119 contacts and activates switch 118 to activate a speed control system (not shown) to cushion the stopping of carriage assembly 30 as it returns to its first position. As the folding arm assembly 44 returns to its first position, switch 111 is activated and the components of the carton erector assembly are in their initial position ready to grasp the next carton blank and repeat the operating cycle.

Thus, there has been described a novel erecting apparatus which facilitates the setting up of knocked-down carton blanks. Although the invention has been described with the requisite degree of particularity, it is understood that the present disclosure has been made only by way of example and that numerous changes in the details of construction and the combination and arrangement of parts may be resorted to without departing from the spirit and scope of the invention as hereinafter claimed.

What is claimed is:

1. Carton erecting apparatus for setting up and bottom closing of cartons which are supplied to the apparatus as knocked-down carton blanks having side and end panels and top and bottom flaps formed integral therewith; said apparatus comprising:

(a) a carton blank storage section having a magazine means for storing and urging knocked-down carton blanks in a substantially vertical orientation with their bottom flaps lowermost towards a carton set-up section positioned adjacent to said carton blank storage section;

(b) said carton set-up section including a carton opening assembly for receiving a carton blank from said magazine means in a substantially vertical orientation and setting up said carton blank in a tubular form, said carton opening assembly having a folding arm and a pivot arm, said folding arm being secured to a first substantially vertical shaft pivotal about a substantially vertical and movable between a first position generally parallel to the side panel of said knocked-down carton blank in said magazine means and a second position generally perpendicular to the side panel of said knocked-down carton blank, said pivot arm being secured to a second substantially vertical shaft pivotally secured to said folding arm and movable between a first position substantially parallel to said folding arm and a second position substantially perpendicular to said folding arm, said carton opening assembly having a first means for moving said folding arm between its first and second positions, said carton opening assembly having a second means for moving said pivot arm between its first and second positions, said carton opening assembly having a grasping means associated with said pivot arm for grasping a side panel of said carton blank from said magazine means when said pivot arm and said folding arm are in their respective first positions such that upon subsequent movement of said pivot arm and said folding arm into their respective second positions an end panel of said carton blank contacts comprising means associated with said folding arm for urging said carton blank into a set-up tubular form;

(c) said apparatus having a bottom flap folding section positioned adjacent said carton set-up section, said bottom flap folding section having a bottom flap folding means associated therewith for infolding the bottom flaps of the set-up carton; and (d) a carriage assembly having a substantially horizontal carriage plate mounted in said bottom flap folding section for movement through a substantially horizontal plane by a third means connected to said carriage plate between a first position within said bottom flap folding section and a second position extending into said carton set up section and comprising means for receiving and delivery of the set-up carton into said bottom flap folding section without interferring with the operation of said carton opening assembly.

2. The invention as defined in claim 1 wherein said first means is a pneumatic cylinder means mounted in said carton set-up section for movement of said folding arm between its first and second positions about said first shaft.

3. The invention as defined in claim 1 wherein said second means is a pneumatic cylinder means mounted in said carton set-up section for movement of said pivot arm between its first and second positions about said second shaft.

4. The invention as defined in claim 1 wherein said third means is a pneumatic cylinder means.

5. The invention as defined in claim 1 wherein said bottom flap folding means includes a flap kicker member pivotally mounted within said carton set-up section and movable by fourth means connected to said flap kicker member between a substantially vertical position, when said folding arm and said pivot arm are in their first positions, and a substantially horizontal position to infold the trailing bottom end flap of the carton, when said folding arm and said pivot arm are in their second positions.

6. The invention as defined in claim 1 wherein said bottom flap folding means includes a longitudinally extending plough member mounted to said carriage plate for infolding the leading bottom end flap of the carton as said carriage assembly moves into its second position.

7. The invention as defined in claim 6 wherein said bottom flap folding means further includes a pair of converging side plough bars mounted in said bottom flap folding section for infolding the bottom side flaps of the carton as the carton travels therethrough.

8. The invention as defined in claim 1 wherein said grasping means includes at least one suction cup in communication with a source of vacuum for grasping a side panel of said carton blank.

9. The invention as defined in claim 8 wherein said suction cup is selectively vertically and horizontally adjustable relative to said pivot arm.

10. The invention as defined in claim 1 wherein said carriage assembly includes a pair of transversely spaced apart longitudinally extending carton receiving assembly means for contacting the side panels of a set-up carton within said carton set-up section as said carriage assembly moves into its second position and delivers same into said bottom flap folding section as said carriage assembly returns to its first position.

11. The invention as defined in claim 10 wherein said carton receiving assembly means includes a plurality of longitudinally spaced apart roller means for contacting the side panels of a set-up carton within said carton set-up section.

12. The invention as defined in claim 11 wherein at least one of said roller means is a brake roller.

13. The invention as defined in claim 10 wherein said carton receiving assembly means is selectively transversely adjustable towards and away from a longitudinal center line of said carriage assembly.

14. The invention as defined in claim 10 including first switch means for activating said first means so as to move said folding arm from its first position towards its second position.

15. The invention as defined in claim 14 wherein said first switch means further activates said second means so as to move said pivot arm from its first position towards its second position.

16. The invention as defined in claim 15 wherein said first switch means further activates said grasping means.

17. The invention as defined in claim 14 including second switch means for activating said third means so as to move said carriage assembly from its first position towards its second position as said pivot arm reaches its second position.

18. The invention as defined in claim 17 wherein said bottom flap folding means includes a flap kicker member pivotally mounted within said carton set-up section and movable by fourth means connected to said flap kicker member between a substantially vertical first position and a substantially horizontal second position.

19. The invention as defined in claim 18 wherein said second switch means further activates said fourth means so as to move said kicker member from its first position towards its second position to infold the trailing bottom flap of a set-up carton within said carton set-up section.

20. The invention as defined in claim 17 further including third switch means for deactivating said grasping means as said carriage assembly reaches its second position.

21. The invention as defined in claim 20 wherein said third switch means further activates said second means so as to move said pivot arm from its second position towards its first position.

22. The invention as defined in claim 20 further including a fourth switch means for activating said third means so as to move said carriage assembly from its second position towards its first position.

23. The invention as defined in claim 22 wherein said fourth switch means further activates said fourth means so as to move said flap kicker member from its second position towards its first position.

24. The invention as defined in claim 22 wherein said third switch means further activates said first means so as to move said folding arm from its second position towards its first position.

* * * * *